US011994322B2

(12) United States Patent
Yoo et al.

(10) Patent No.: US 11,994,322 B2
(45) Date of Patent: May 28, 2024

(54) REFRIGERATOR

(71) Applicant: SAMSUNG ELECTRONICS CO., LTD., Suwon-si (KR)

(72) Inventors: Jung Woo Yoo, Suwon-si (KR); Ju Young Kim, Suwon-si (KR); Kook Jeong Seo, Suwon-si (KR); Su-Cheol Yoo, Suwon-si (KR); Won-Jae Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 364 days.

(21) Appl. No.: 17/416,785

(22) PCT Filed: Dec. 18, 2019

(86) PCT No.: PCT/KR2019/017985
§ 371 (c)(1),
(2) Date: Jun. 21, 2021

(87) PCT Pub. No.: WO2020/141764
PCT Pub. Date: Jul. 9, 2020

(65) Prior Publication Data

US 2022/0082311 A1 Mar. 17, 2022

(30) Foreign Application Priority Data

Jan. 3, 2019 (KR) ..... 10-2019-0000752

(51) Int. Cl.
*F25B 41/40* (2021.01)
*F25B 13/00* (2006.01)
(Continued)

(52) U.S. Cl.
CPC ..... *F25B 41/40* (2021.01); *F25B 13/00* (2013.01); *F25B 39/04* (2013.01); *F25D 11/022* (2013.01)

(58) Field of Classification Search
CPC ..... F25D 2323/00261; F25D 23/003; F25D 17/06; F25D 23/006; F25D 19/00;
(Continued)

(56) References Cited

U.S. PATENT DOCUMENTS 5,117,523 A 6/1992 Jacobus et al.
8,522,565 B1 * 9/2013 Hauck ..... F25D 19/02 62/448
(Continued)

FOREIGN PATENT DOCUMENTS

JP 5-215457 8/1993
JP 2002-333259 11/2002
(Continued)

OTHER PUBLICATIONS

International Search Report dated Apr. 22, 2020 from International Patent Application No. PCT/KR2019/017985, 7 pages.
Korean Office Action dated Nov. 28, 2023 for Korean Application No. 10-2019-0000752.

*Primary Examiner* — Ana M Vazquez
(74) *Attorney, Agent, or Firm* — STAAS & HALSEY LLP

(57) ABSTRACT

A refrigerator includes a main body having a storage compartment formed therein, and a cooling module forming a machine compartment in which a compressor is disposed and detachably mounted to the main body. The cooling module includes a module body forming the machine compartment, a condenser of an L shape disposed on one side of the compressor and including a first part corresponding to a portion of a rear surface of the machine compartment and a second part corresponding to one side of the machine compartment. The condenser is vertically mounted on a base plate disposed below the module body. A module cover is
(Continued)

provided to cover the rear of the machine compartment, and a suction flow path includes first and second suction flow paths.

12 Claims, 8 Drawing Sheets

(51) Int. Cl.
*F25B 39/04* (2006.01)
*F25D 11/02* (2006.01)

(58) Field of Classification Search
CPC ..... F25D 2317/067; F25D 17/065; F25D 11/022; F25B 39/04; F25B 13/00; F25B 41/40
See application file for complete search history.

(56) References Cited

U.S. PATENT DOCUMENTS

| | | | | |
|---|---|---|---|---|
| 2019/0003758 | A1* | 1/2019 | Scalf | F25D 29/00 |
| 2020/0141629 | A1* | 5/2020 | Seo | F25D 23/062 |

FOREIGN PATENT DOCUMENTS

| | | | | |
|---|---|---|---|---|
| KR | 10-0593086 | | 6/2006 | |
| KR | 10-0596524 | | 7/2006 | |
| KR | 10-0724445 | | 6/2007 | |
| KR | 10-2011-0029135 | | 3/2011 | |
| KR | 10-2015-0129250 | | 11/2015 | |
| KR | 10-1659012 | | 9/2016 | |
| KR | 10-1726223 | | 4/2017 | |
| WO | WO-2017158714 | A1 * | 9/2017 | F25B 39/04 |

* cited by examiner

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2019/017985, filed Dec. 18, 2019 which claims the foreign priority benefit under 35 U.S.C. § 119 of Korean Patent Application No. 10-2019-0000752, filed Jan. 3, 2019, the contents of which are incorporated herein by reference.

TECHNICAL FIELD

The present disclosure relates to a refrigerator in which a structure of a machine compartment is improved to secure a volume of a storage compartment.

BACKGROUND ART

A refrigerator is a home appliance including a main body having a storage compartment, a cold air supply device for supplying cold air to the storage compartment, and a door for opening and closing the storage compartment to keep food fresh.

The storage compartment includes a refrigerating compartment that is maintained at temperature of about 0 degrees Celsius to 5 degrees Celsius to keep food refrigerated, and a freezing compartment that is maintained at temperature of about 0 degrees Celsius to −30 degrees Celsius to keep food frozen.

A machine compartment is formed at a rear lower portion of the storage compartment, and in the machine compartment, a compressor, a condenser, and a cooling fan are disposed to supply cold air.

Because the condenser placed in the machine compartment has a U shape or rectangular parallelepiped shape, a space inside the machine compartment may not be efficiently utilized.

DISCLOSURE

Technical Problem

The present disclosure is directed to providing a refrigerator capable of securing a volume of a storage compartment by improving a shape of a condenser disposed in a machine compartment.

Technical Solution

An aspect of the present disclosure provides a refrigerator including a main body having a storage compartment formed therein, and a cooling module forming a machine compartment in which a compressor is disposed and detachably mounted to the main body, wherein the cooling module includes a module body forming the machine compartment, a condenser of an L shape disposed on one side of the compressor and including a first part corresponding to a portion of a rear surface of the machine compartment and a second part corresponding to one side of the machine compartment, a base plate disposed below the module body and on which the condenser is vertically mounted, a module cover provided to cover the rear of the machine compartment, and a suction flow path including a first suction flow path formed on the module cover to correspond to the first part, and a second suction flow path formed on the main body to correspond to the second part.

The refrigerator may further include a first discharge flow path formed on the module cover to allow air inside the machine compartment to be discharged to the outside, and a second discharge flow path formed on the base plate to allow air inside the machine compartment to be discharged to the outside.

The cooling module may further include an evaporator to generate cold air to be supplied to the storage compartment, and the module body may include an evaporator mount in which the evaporator is mounted.

The storage compartment may include a first storage compartment provided as a refrigerating compartment, a second storage compartment provided below the first storage compartment as a freezing compartment, and a third storage compartment provided on one side of the second storage compartment as a temperature variable compartment.

The evaporator may include a first evaporator to generate cold air to be supplied to the first storage compartment and the third storage compartment, and a second evaporator to generate cold air to be supplied to the second storage compartment and the third storage compartment.

The evaporator mount may include a first evaporator mounting part in which the first evaporator is mounted, and a second evaporator mounting part in which the second evaporator is mounted.

The second evaporator may have a larger capacity than the first evaporator, and the second evaporator mounting part may be provided to be longer downward than the first evaporator mounting part.

The condenser may be disposed at a lower portion of the second evaporator mounting part, and the lower portion of the second evaporator mounting part having a length longer than that of the first evaporator mounting part may be provided to be located in the front of the condenser.

The cooling module may further include a duct module configured to move cold air generated in the evaporator to the storage compartment.

The duct module may include a first duct module disposed in the first evaporator mounting part to move cold air generated in the first evaporator to the first storage compartment and the third storage compartment, and a second duct module disposed in the second evaporator mounting part to move cold air generated in the second evaporator to the second storage compartment and the third storage compartment.

The first duct module may be connected to the first storage compartment by a first cold air duct and to the third storage compartment by a third cold air duct.

The second duct module may be connected to the second storage compartment by a second cold air duct.

The first duct module may include a first-a fan outlet in communication with the first cold air duct and a first-b fan outlet in communication with the third cold air duct.

The second duct module may include a second fan outlet in communication with the second cold air duct.

The module body may include a separation wall to separate the first evaporator mounting part and the second evaporator mounting part, and a connection duct provided on the separation wall to communicate the first evaporator mounting part and the second evaporator mounting part.

Advantageous Effects

According to embodiments of the present disclosure, a space formed in the front of a condenser can be utilized by improving a shape of the condenser, thereby securing a volume of a storage compartment.

MODE FOR INVENTION

Figure 1:
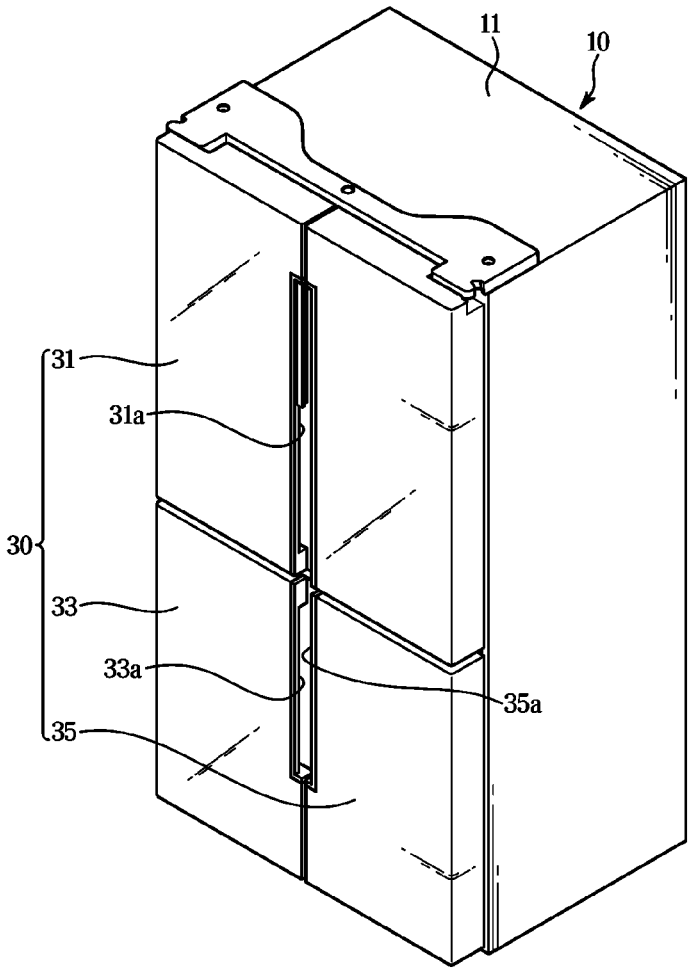
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 2:
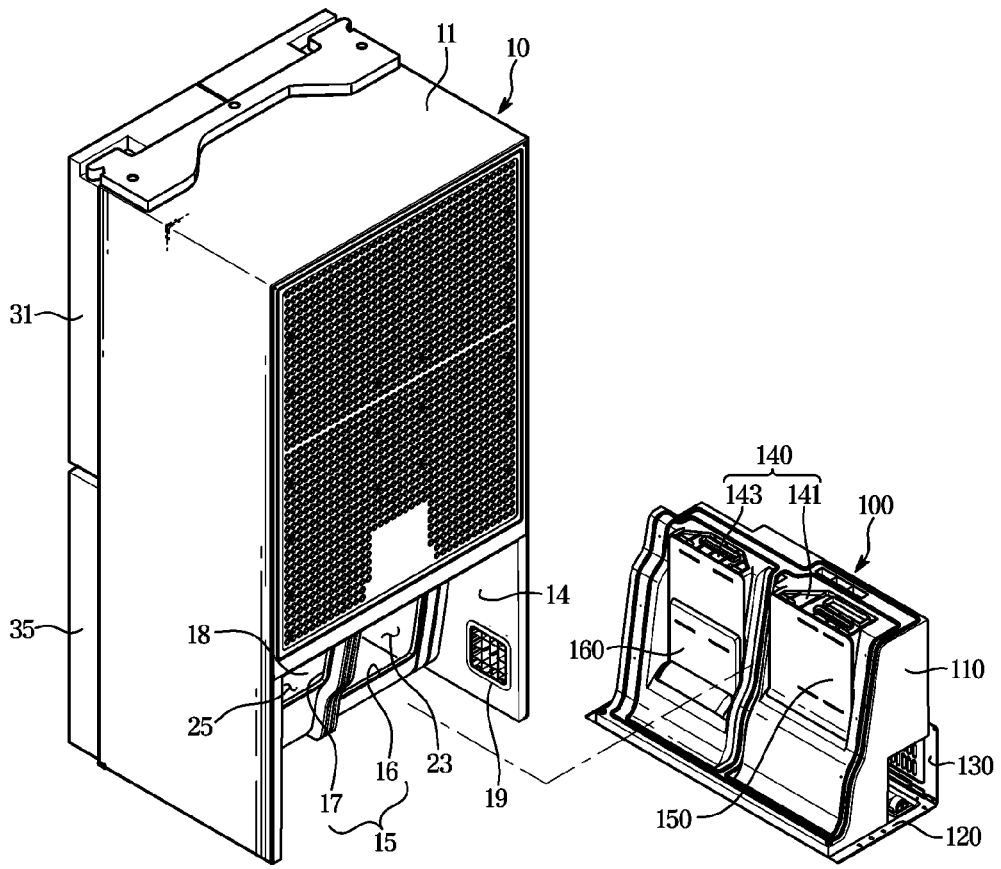
FIG. 2 is a view illustrating a state in which a cooling module is separated from a main body of the refrigerator according to an embodiment of the present disclosure.
Figure 3:
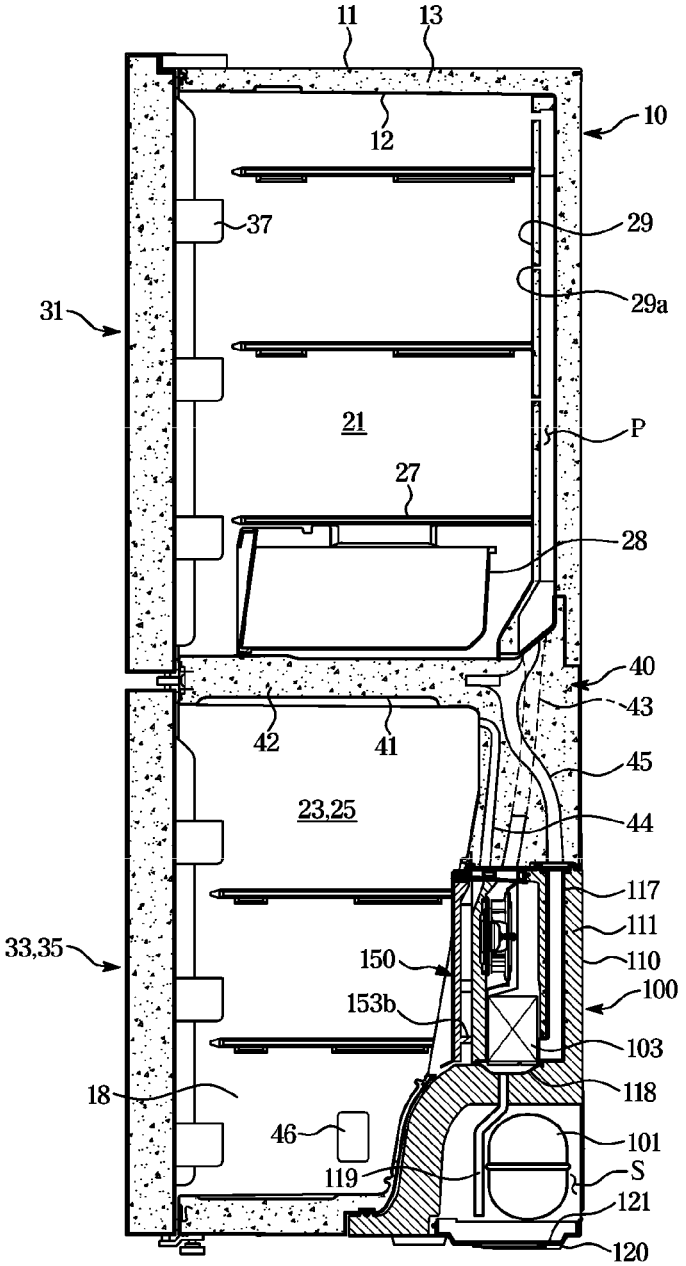
FIG. 3 is a cross-sectional view of the refrigerator according to an embodiment of the present disclosure.

FIG. 1 is a perspective view of a refrigerator according to an embodiment of the present disclosure, FIG. 2 is a view illustrating a state in which a cooling module is separated from a main body of the refrigerator according to an embodiment of the present disclosure, and FIG. 3 is a cross-sectional view of the refrigerator according to an embodiment of the present disclosure.

As illustrated in FIGS. 1 to 3, the refrigerator may include a main body 10 forming an outer appearance, a storage compartment 20 having an open front side and provided inside the main body 10, a door 30 rotatably coupled to the main body 10 to open and close the open front side of the storage compartment 20, and a cooling module 100 detachably mounted on the main body 10 to supply cold air to the storage compartment 20.

The main body 10 may include an outer case 11 and an inner case 12 coupled to an inner side of the outer case 11. The outer case 11 may be formed of a metal material.

The inner case 12 may form the storage compartment 20. The inner case 12 may be formed by injection molding of a plastic material.

An insulator 13 may be provided between the outer case 11 and the inner case 12. Urethane foam insulation may be used as the insulator 13, and a vacuum insulation panel may be used together as necessary.

The main body 10 may include an intermediate body 40 having a partition wall 41 to partition the storage compartment 20. By the partition wall 41, the storage compartment 20 may be partitioned into a first storage compartment 21 located at an upper side thereof, and a second storage compartment 23 and a third storage compartment 25 located below the first storage compartment 21. The intermediate body 40 may include an intermediate body insulator 42 therein to prevent heat exchange between the first storage compartment 21, the second storage compartment 23 and the third storage compartment 25. The intermediate body insulator 42 may be provided to prevent loss of cold air to the outside from a portion of a rear surface of the second storage compartment 23 and the third storage compartment 25.

Inside the intermediate body 40, a first cold air duct 43, a second cold air duct (not shown), a third cold air duct 44, and a first circulation duct 45 may be disposed. The first cold air duct 43, the second cold air duct, the third cold air duct 44, and the first circulation duct 45 may be disposed to penetrate the intermediate body insulator 42. Details of the first cold air duct 43, the second cold air duct, the third cold air duct 44, and the first circulation duct 45 will be described later.

The storage compartment 20 may be provided with the open front side to allow food to be put in and taken out. The storage compartment 20 may include the first storage compartment 21, the second storage compartment 23 and the third storage compartment 25. The first storage compartment 21 may be used as a refrigerating compartment that is maintained at temperature of about 0 degrees Celsius to 5 degrees Celsius to keep food refrigerated.

A guide cover 29 to distribute cold air supplied from the first cold air duct 43 may be disposed in the first storage compartment 21. The guide cover 29 may form a flow path P through which cold air transmitted from the first cold air duct 43 flows, together with the inner case 12.

The guide cover 29 may include a guide hole **29*a* to supply cold air transmitted from the first cold air duct 43 to the first storage compartment 21. A plurality of the guide holes 29*a*** may be provided in a vertical direction.

The main body 10 may include a partition plate 18 to partition the second storage compartment 23 and the third storage compartment 25 which are located below the first storage compartment 21. The second storage compartment 23 may be used as a freezing compartment that is maintained at temperature of about 0 degrees Celsius to −30 degrees Celsius to keep food frozen. The third storage compartment 25 may be used as a temperature variable compartment provided such that temperature therein may be varied. However, the use of the first storage compartment 21, the second storage compartment 23, and the third storage compartment 25 may be changed.

The open front side of storage compartment 20 may be opened and closed by the door 30. The storage compartment 20 may be provided with a shelf 27 to allow food to be placed thereon and a storage container 28 to allow food to be stored therein.

The door 30 may include a first door 31 to open and close the first storage compartment 21, a second door 33 to open and close the second storage compartment 23, and a third door 35 to open and close the third storage compartment 25. The first door 31, the second door 33, and the third door 35 may be rotatably coupled to the main body 10.

The first door 31, the second door 33, and the third door 35 may include a first door handle 31*a*, a second door handle 33*a*, and a third door handle 35*a*, respectively, to allow the user to grip and open and close the first door 31, the second door 33, and the third door 35. Door guards 37 to allow food to be stored therein may be provided on rear surfaces of the first door 31, the second door 33, and the third door 35.

A cooling module mount 15 to which the cooling module 100 is detachably mounted may be provided at a lower portion of the main body 10. The cooling module mount 15 may be provided in a size and shape corresponding to the cooling module 100.

The main body 10 may include a storage compartment opening 15. The storage compartment opening 15 may be formed on the cooling module mount 14. The storage compartment opening 15 may include a first storage compartment opening 16 to communicate the cooling module mount 14 and the second storage compartment 23, and a second storage compartment opening 17 to communicate the cooling module mount 14 and the third storage compartment 25. A second suction flow path 19 through which air is sucked may be formed at a portion forming a side wall of the machine compartment S of the main body 10. The second suction flow path 19 will be described later.

Figure 4:
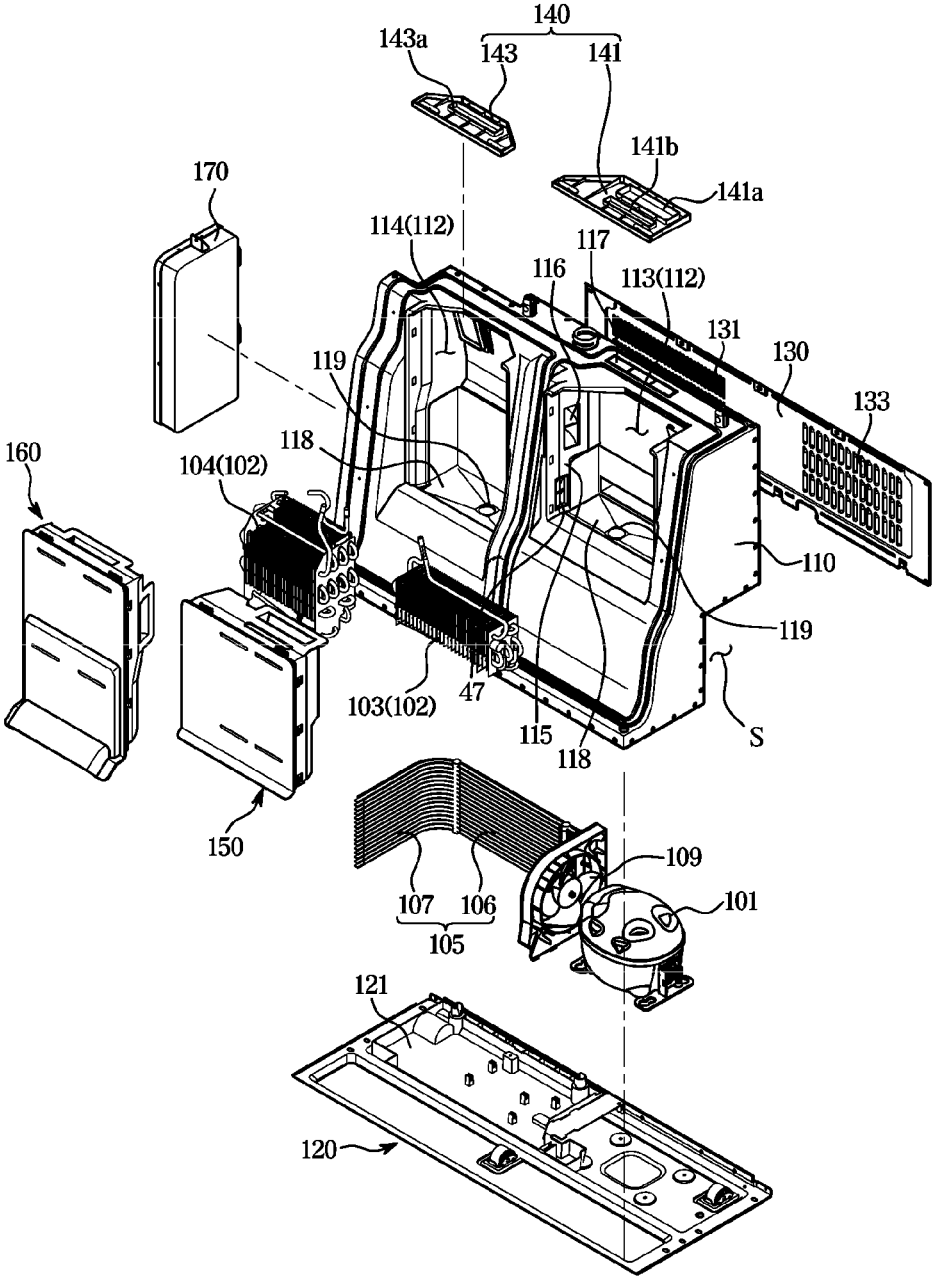
FIG. 4 is an exploded perspective view of the cooling module of the refrigerator according to an embodiment of the present disclosure.
Figure 5:
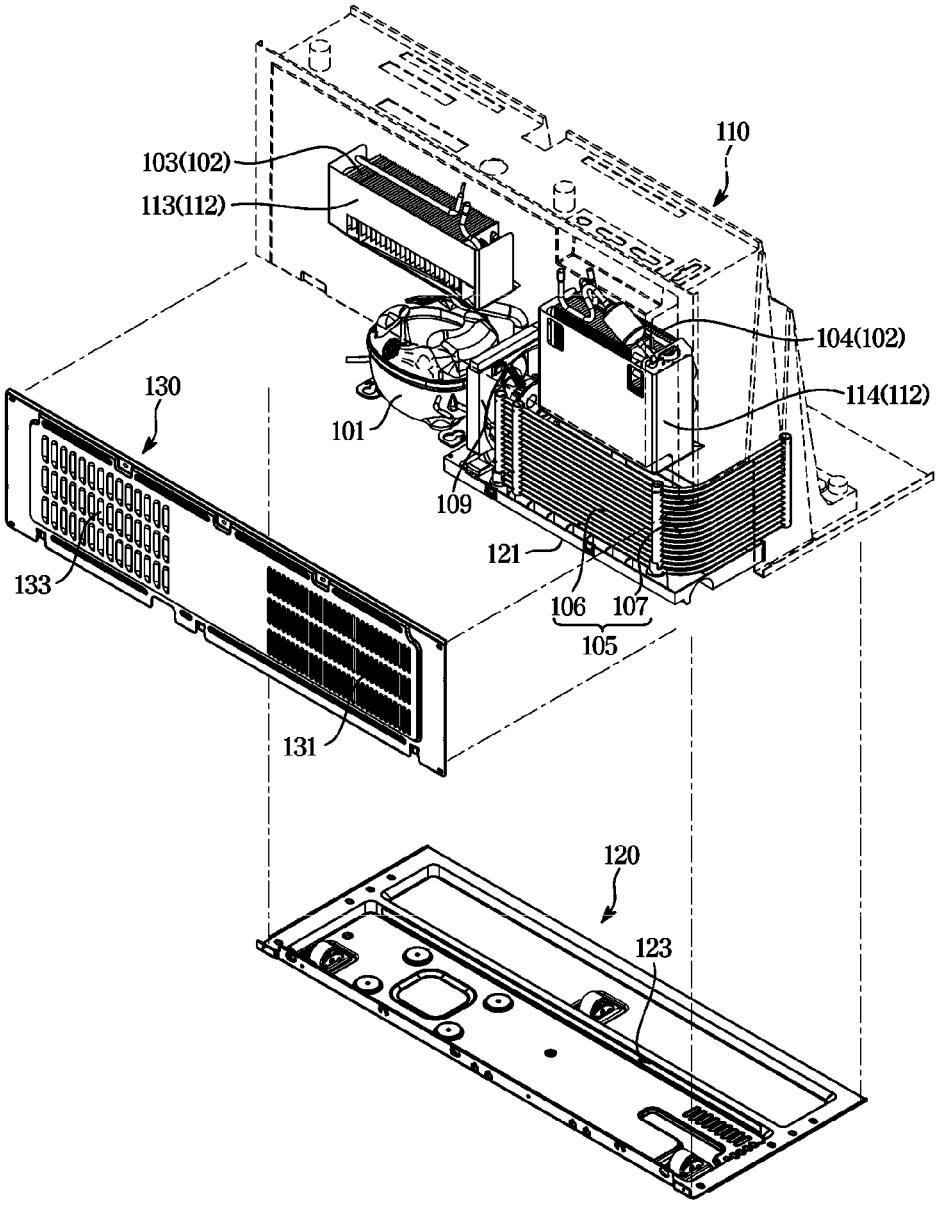
FIG. 5 is a view illustrating a part of the cooling module of the refrigerator according to an embodiment of the present disclosure in a different direction from the cooling module illustrated in FIG. 4.
Figure 6:
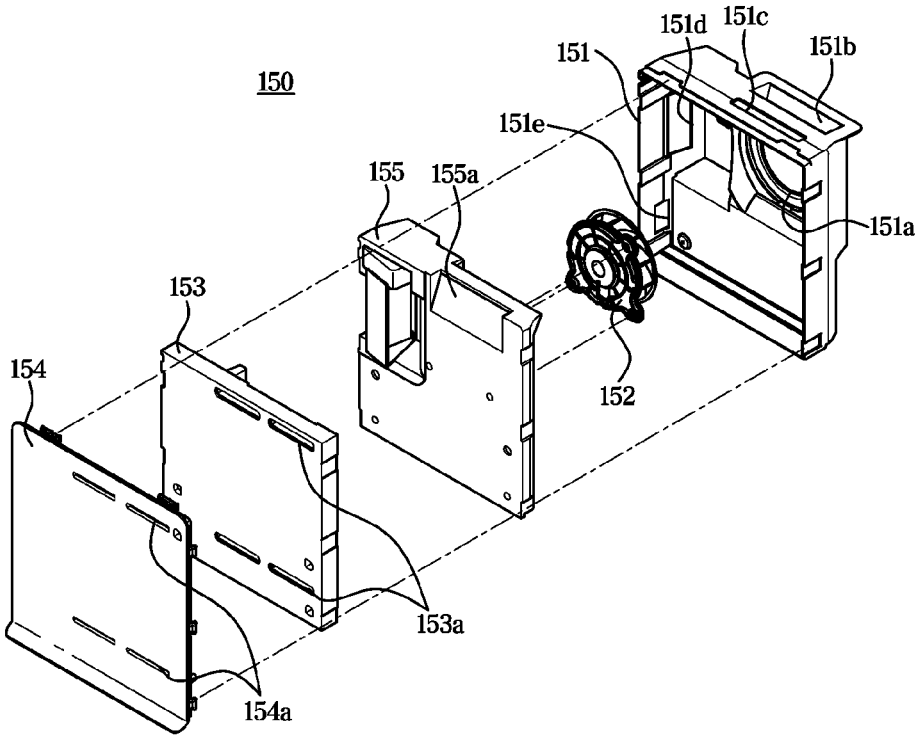
FIG. 6 is an exploded perspective view of a first duct module of the refrigerator according to an embodiment of the present disclosure.
Figure 7:
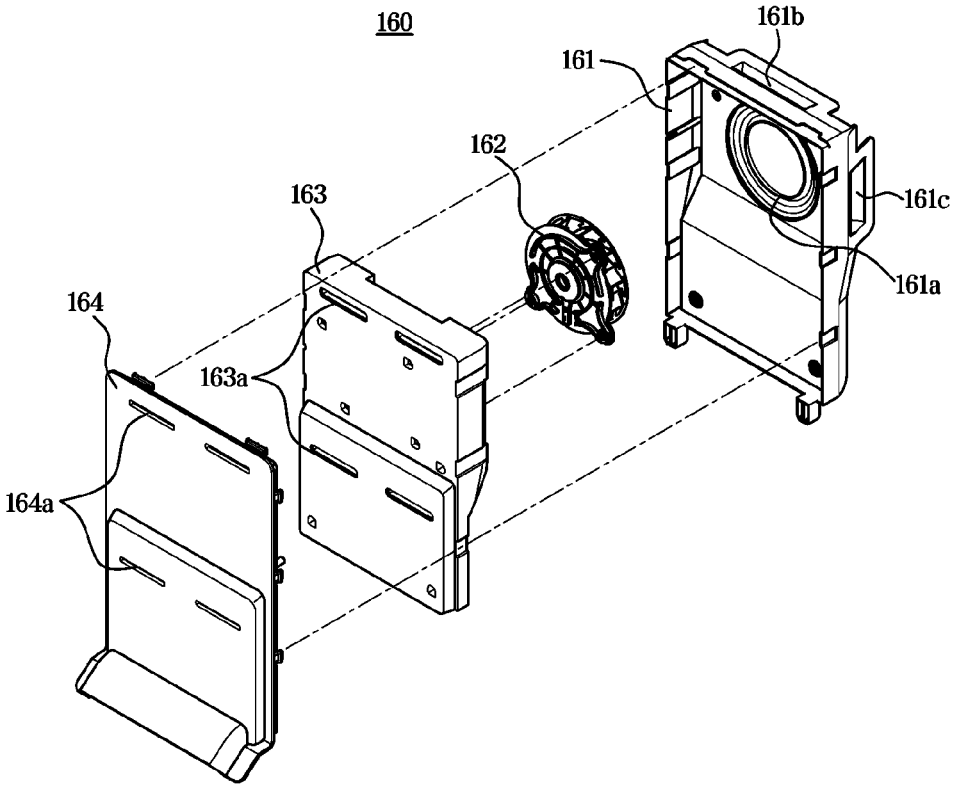
FIG. 7 is an exploded perspective view of a second duct module of the refrigerator according to an embodiment of the present disclosure.

FIG. 4 is an exploded perspective view of the cooling module of the refrigerator according to an embodiment of the present disclosure, FIG. 5 is a view illustrating a part of the cooling module of the refrigerator according to an embodiment of the present disclosure in a different direction from the cooling module illustrated in FIG. 4, FIG. 6 is an exploded perspective view of a first duct module of the refrigerator according to an embodiment of the present disclosure, and FIG. 7 is an exploded perspective view of a second duct module of the refrigerator according to an embodiment of the present disclosure.

As illustrated in FIGS. 4 to 7, the cooling module 100 may generate cold air using the latent heat of evaporation of a refrigerant through a cooling cycle. The cooling module 100 may be configured to generate cold air to be supplied to the first storage compartment 21, the second storage compartment 23, and the third storage compartment 25. The cooling module 100 may be detachably mounted outside the main body 10 (see FIG. 2).

The cooling module 100 may include a compressor 101, an evaporator 102, a condenser 105, a cooling fan 109, and an expansion valve (not shown). The cooling module 100 may include a module body 110 on which the evaporator 102 is mounted and forming the machine compartment S, a base plate 120 mounted below the module body 110, and a module cover 130 to cover a rear surface of the machine compartment S.

The compressor 101, the condenser 105, and the cooling fan 109 are disposed inside the machine compartment S formed by the module body 110, and the evaporator 102 may be mounted on an evaporator mount 112 of the module body 110.

The compressor 101 may compress the refrigerant and move the compressed refrigerant to the condenser 105. The condenser 105 may condense refrigerant and move the condensed refrigerant to the expansion valve. The cooling fan 109 may cool the compressor 101 and the condenser 105. As the cooling fan 109 is driven, air may be introduced into the machine compartment S through a first suction flow path 131 and the second suction flow path 19, and heat exchanged with the condenser 105 and the compressor 101, and then discharged to the outside of the machine compartment S through a first discharge flow path 133 and a second discharge flow path 123.

The evaporator 102 may be configured to generate cold air. The evaporator 102 may be disposed on the evaporator mount 112. The evaporator 102 may include a first evaporator 103 to generate cold air to be supplied to the first storage compartment 21 and the third storage compartment 25, and a second evaporator 104 to generate cold air to be supplied to the second storage compartment 23 and the third storage compartment 25. The first evaporator 103 may be mounted on a first evaporator mounting part 113. The second evaporator 104 may be disposed on a second evaporator mounting part 114.

The condenser 105 is disposed on one side of the compressor 101 and may be mounted perpendicularly to the base plate 120. The condenser 105 may be formed as a flat plate having an L shape. The condenser 105 may include a first part 106 corresponding to a portion of the rear surface of the machine compartment S, and a second part 107 corresponding to one side of the machine compartment S. Because the condenser 105 is formed as a flat plate having an L shape, a space formed in the front of the condenser 105 in a space inside the machine compartment S may be utilized for other purposes.

The second evaporator 104 for generating cold air to be supplied to the second storage compartment 23 used as the freezing compartment may have a larger capacity than the first evaporator 103. Accordingly, the second evaporator mounting part 114 on which the second evaporator 104 is mounted may be provided to be longer downward than the first evaporator mounting part 113 on which the first evaporator 103 is mounted. The condenser 105 may be disposed below the second evaporator mounting part 114. A lower portion of the second evaporator mounting part 114 provided to be longer downward than the first evaporator mounting part 113 may be located in a space formed in the front of the condenser 105. Because the space formed in the front of the condenser 105 may be utilized as a space in which the lower portion of the second evaporator mounting part 114 is located, a volume of the storage compartment 20 may be secured.

The condenser 105 may include the first part 106 corresponding to a portion of the rear surface of the machine compartment S, and the second part 107 corresponding to one side of the machine compartment S. The suction flow paths 131 and 19 through which outside air is sucked may be formed at portions of the machine compartment corresponding to the condenser 105. The suction flow paths 131 and 19 may include the first suction flow path 131 formed on the module cover 130, which is a position corresponding to the first part 106 of the condenser 105, and the second suction flow path 19 formed on the body 10 forming a side wall of the machine compartment S, which is a position corresponding to the second part 107 of the condenser 105. Because the condenser 105 is provided to have an L shape, the suction flow paths 131 and 19 may be formed only at the rear and one side of the condenser 105. Because the suction flow path is not formed in the front of the condenser 105, the space formed in the front of the condenser 105 may be utilized for other purposes.

The module body 110 may form a portion of a rear surface of the refrigerator. The module body 110 may include a module insulator 111 provided therein to prevent loss of cold air generated in the evaporator 102.

The module body 110 may include the evaporator mount 112 on which the evaporator 102 is mounted. Specifically, the evaporator mount 112 may include the first evaporator mounting part 113 on which the first evaporator 103 is mounted and the second evaporator mounting part 114 on which the second evaporator 104 is mounted.

The module body 110 may include a separation wall 115 disposed between the first evaporator mounting part 113 and the second evaporator mounting part 114. The separation wall 115 may be disposed to correspond to a boundary between the second storage compartment 23 and the third storage compartment 25. The module insulator 111 may also be disposed inside the separation wall 115.

A connection duct 116 disposed to penetrate the module insulator 111 may be provided on the separation wall 115. The connection duct 116 may be provided to move cold air to be supplied to the third storage compartment 25. The connection duct 116 may be provided to communicate the first evaporator mounting part 113 and the second evaporator mounting part 114. One end of the connection duct 116 may be connected to a first fan connection port 151*d*, and the other end thereof may be connected to a second connection port 161*c*.

The separation wall 115 may be provided with a second circulation duct 46 disposed to penetrate the module insulator 111. The second circulation duct 46 may be provided such that a part of air that has cooled the third storage compartment 25 moves to the second storage compartment 23. The air moved to the second storage compartment 23 through the second circulation duct 46 may be recovered to the second evaporator mounting part 114 together with the air that has cooled the second storage compartment 23.

The separation wall 115 may be provided with a third circulation duct 47 disposed to penetrate the module insulator 111. The third circulation duct 47 may be provided such that the air that has cooled the third storage compartment 25 moves to the second evaporator 104. The third circulation duct 47 may be provided to communicate the first evaporator mounting part 113 and the second evaporator mounting part 114. The third circulation duct 47 may be provided to communicate a portion of a space formed between a separation cover 155 and a first fan cover 153 with a space in which the second evaporator 104 is disposed.

A guide duct 117 may be provided in the module body 110. The guide duct 117 may be disposed to penetrate the module insulator 111 of the module body 110. The guide duct 117 may be connected to the first circulation duct 45. The guide duct 117 may communicate the first circulation duct 45 with the first evaporator mounting part 113 on which the first evaporator 103 is mounted.

The base plate 120 may be disposed below the module body 110. The base plate 120 may cover a lower portion of the module body 110. The compressor 101 may be fixed to the base plate 120. The condenser 105 may be vertically fixed to the base plate 120. The cooling fan 109 may be fixed to the base plate 120.

A collecting pan 121 may be disposed on the base plate 120. The collecting pan 121 may collect condensed water generated from the condenser 105 and/or the evaporator 102. The condenser 105 may be disposed above the collecting pan 121.

The module body 110 may include a drain pan 118 to guide the condensed water generated in the evaporator 102 to the collecting pan 121, and a drain pipe 119. The drain pan 118 may be disposed below the evaporator 102. The drain pan 118 may be disposed below the first evaporator 103 and below the second evaporator 104, respectively. The drain pan 118 may be disposed on the first evaporator mounting part 113 and the second evaporator mounting part 114, respectively.

The drain pipe 119 may be provided to guide the condensed water collected in the drain pan 118 to the collecting pan 121. At least a portion of the drain pipe 119 may be disposed to penetrate the module insulator 111.

An electric module 170 may be disposed on the base plate 120. The electric module 170 may be disposed on one side on which the second evaporator mounting part 114 is disposed. The electric module 170 may control the cooling module 100 to change a temperature of the storage compartment 20.

The module cover 130 may cover a rear lower side of the module body 101. The module cover 130 may cover the machine compartment S, which is provided at the lower portion of the module body 110, together with the base plate 120 so that the compressor 101, the condenser 105, and the cooling fan 109 may be disposed. The module cover 130 may include the first suction flow path 131 through which outside air is introduced by the cooling fan 109, and the first discharge flow path 133 through which the introduced air is discharged to the outside.

The cooling module 100 may include a cap 140 to cover an open upper side of the evaporator mount 112. The cap 140 may include a first cap 141 to cover an upper portion of the first evaporator mounting part 113, and a second cap 143 to cover an upper portion of the second evaporator mounting part 114.

The first cap 141 may be disposed above a first fan case 151. The first cap 141 may include a first hole 141*a* provided to correspond to a first-a fan outlet 151*b*, and a second hole 141*b* provided to correspond to a 1b fan outlet 151*c*. The first hole 141*a* may be formed to be in communication with the first cold air duct 43. The second hole 141*b* may be formed to be in communication with the third cold air duct 44.

The second cap 143 may be disposed above a second fan case 161. The second cap 143 may include a third hole 143*a* provided to correspond to a second fan outlet 161*b*. The third hole 143*a* may be formed to be in communication with the second cold air duct.

Duct modules 150 and 160 to move cold air generated by the evaporator 102 to the storage compartment 20 may be disposed in the evaporator mount 112. The duct modules 150 and 160 may include the first duct module 150 disposed in the first evaporator mounting part 113, and the second duct module 160 disposed in the second evaporator mounting part 114.

Specifically, the first duct module 150 may include the first fan case 151, a first fan 152, the first fan cover 153, a first duct cover 154, and the separation cover 155.

The first fan case 151 may be disposed to cover the first fan 152. The first fan case 151 may be detachably coupled to the first evaporator mounting part 113. The first fan case 151 may be fixed to the module body 110.

The first fan case 151 may include a first fan inlet 151*a* through which air exchanged with the first evaporator 103 is introduced. The first fan inlet 151*a* may be formed on a rear surface of the first fan case 151.

The first fan case 151 may include the first fan outlet 151*b* in communication with the first cold air duct 43. The first-a fan outlet 151*b* may be provided to allow cold air to be supplied to the first storage compartment 21 to be discharged. The first-a fan outlet 151*b* may be formed on an upper surface of the first fan case 151.

The first fan case 151 may include a first-b fan outlet 151*c* in communication with the third cold air duct 44. The first-b fan outlet 151*c* may be provided to allow cold air to be supplied to the third storage compartment 25 to be discharged. The first-b fan outlet 151*c* may be formed on the upper surface of the first fan case 151.

The first fan case 151 may include the first fan connection port 151*d* in communication with the connection duct 116. The first fan connection port 151*d* may be provided such that air blown by a second fan 162 is introduced. The first fan connection port 151*d* may be provided to allow cold air to be supplied to the third storage compartment 25 to be introduced. The first fan connection port 151*d* may be formed on a side surface of the first fan case 151.

The first fan case 151 may include a first fan circulation port 151*e* in communication with the third circulation duct 44. The first fan circulation port 151*e* may be provided to guide air that has cooled the third storage compartment 25 to the second evaporator 104. The first fan circulation port 151*e* may be formed on a side surface of the first fan case 151 facing the separation wall 115.

The first fan 152 may be driven to supply air heat-exchanged with the first evaporator 103 to the first storage compartment 21. The first fan 152 may be disposed in the first evaporator mounting part 113. The first fan 152 may be fixed to the first fan case 151.

The first fan cover 153 may be coupled to the front of the first fan case 151. The separation cover 155 may be disposed between the first fan cover 153 and the first fan case 151. A separation rib 153*b* to partition a space between the separation cover 155 and the first fan cover 153 may be provided on a rear surface of the first fan cover 153. By the separation rib 153*b*, the space between the first fan cover 153 and the separation cover 155 may be partitioned into a space receiving air from the connection duct 116 and a space in which air that has cooled the third storage compartment 25 is recovered.

The separation cover 155 may cover the front of the first fan case 151. The separation cover 155 may separate spaces formed inside the first fan case 151 and inside the first fan cover 153. The separation cover 155 may form a space in which cold air to be supplied to the first storage compartment 21 moves together with the first fan case 151. The separation cover 155 may form a space in which cold air to be supplied to the third storage compartment 25 moves together with the first fan cover 153. A flow path through which air heat-exchanged with the first evaporator 103 moves may be formed in the rear of the separation cover 155, and a flow path through which air heat-exchanged with the second evaporator 104 moves may be formed in the front of the separation cover 155. A flow path through which air being moved by the first fan 152 flows may be formed in the rear of the separation cover 155, and a flow path through which air being moved by the second fan 162 flows may be formed in the front of the separation cover 155.

The separation cover 155 may prevent the air heat-exchanged with the first evaporator 103 from being mixed with the air heat-exchanged with the second evaporator 104. The separation cover 155 may prevent air being moved by the first fan 152 from being mixed with the air being moved by the second fan 162.

The separation cover 155 may include a hole forming portion 155*a* forming a hole in communication with the third cold air duct 44 when coupled to the first fan cover 153. The hole forming portion 155*a* may be formed on an upper surface of the separation cover 155.

The first fan cover 153 may be disposed in the front of the separation cover 155. The first fan cover 153 may form a space through which cold air to be supplied to the third storage compartment 25 flows together with the separation cover 155. The first fan cover 153 may be fixed to the first fan case 151.

The first fan cover 153 may include a first cover hole 153*a* in communication with the third storage compartment 25. The first cover hole 153*a* may be formed to allow a part of air introduced through the connection duct 116 to be discharged to the third storage compartment 25. A part of the cold air introduced through the connection duct 116 may be moved to the third cold air duct 44 and then supplied to the third storage compartment 25, and the other part may be supplied to the third storage compartment 25 through the first cover hole 153*a*.

The first duct cover 154 may be disposed in the front of the first fan cover 153. The first duct cover 154 may cover the front of the first fan cover 153. The first duct cover 154 may include a first duct hole 154*a* in communication with the third storage compartment 25. The first duct hole 154*a* may be provided to correspond to the first cover hole 153*a*. A part of cold air blown by the second fan 162 may be supplied to the third storage compartment 25 through the first cover hole 153*a* and the first duct hole 154*a*.

The second duct module 160 may include the second fan case 161, the second fan 162, a second fan cover 163, and a second duct cover 164.

The second fan case 161 may be disposed in the second evaporator mounting part 114. The second fan case 161 may include a second fan inlet 161*a* through which air heat-exchanged with the second evaporator 104 is introduced. The second fan inlet 161*a* may be formed on a rear surface of the second fan case 161.

The second fan case 161 may include the second fan outlet 161*b* in communication with the second cold air duct. The second fan outlet 161*b* may allow cold air to be supplied to the second storage compartment 23 to be discharged. The second fan outlet 161*b* may be formed on an upper surface of the second fan case 161.

The second fan case 161 may include the second fan connection port 161*c* in communication with the connection duct 116. The second fan connection port 161*c* may be provided to allow the air blown by the second fan 162 to be discharged to the connection duct 116. The second fan connection port 161*c* may be provided to allow cold air to be supplied to the third storage compartment 25 to be discharged. The second fan connection port 161*c* may be formed on a side surface of the second fan case 161.

The second fan 162 may be driven to supply air heat-exchanged with the second evaporator 104 to the second storage compartment 23 and the third storage compartment 25. The second fan 162 may be disposed in the second evaporator mounting part 114. The second fan 162 may be fixed to the second fan case 161.

The second fan cover 163 may be coupled to the front of the second fan case 161. The second fan cover 163 may cover the front of the second fan case 161. The second fan cover 163 may form a space through which cold air to be supplied to the second storage compartment 23 and the third storage compartment 25 flows together with the second fan case 161. The second fan cover 163 may be fixed to the second fan case 161.

The second fan cover 163 may include a second cover hole 163*a* in communication with the second storage compartment 23. The second cover hole 163*a* may be formed to allow a part of the air blown by the second fan 162 to be discharged to the second storage compartment 23. A part of the air blown by the second fan 162 may be moved to the second cold air duct and then supplied to the second storage compartment 23, and the other part may be supplied to the second storage compartment 23 through the second cover hole 163*a*.

The second duct cover 164 may be disposed in the front of the second fan cover 163. The second duct cover 164 may cover the front of the second fan cover 163.

The second duct cover 164 may include a second duct hole 164*a* in communication with the second storage compartment 23. The second duct hole 164*a* may be provided to correspond to the second cover hole 163*a*. A part of the cold air blown by the second fan 162 may be supplied to the second storage compartment 23 through the second cover hole 163*a* and the second duct hole 164*a*.

Figure 8:
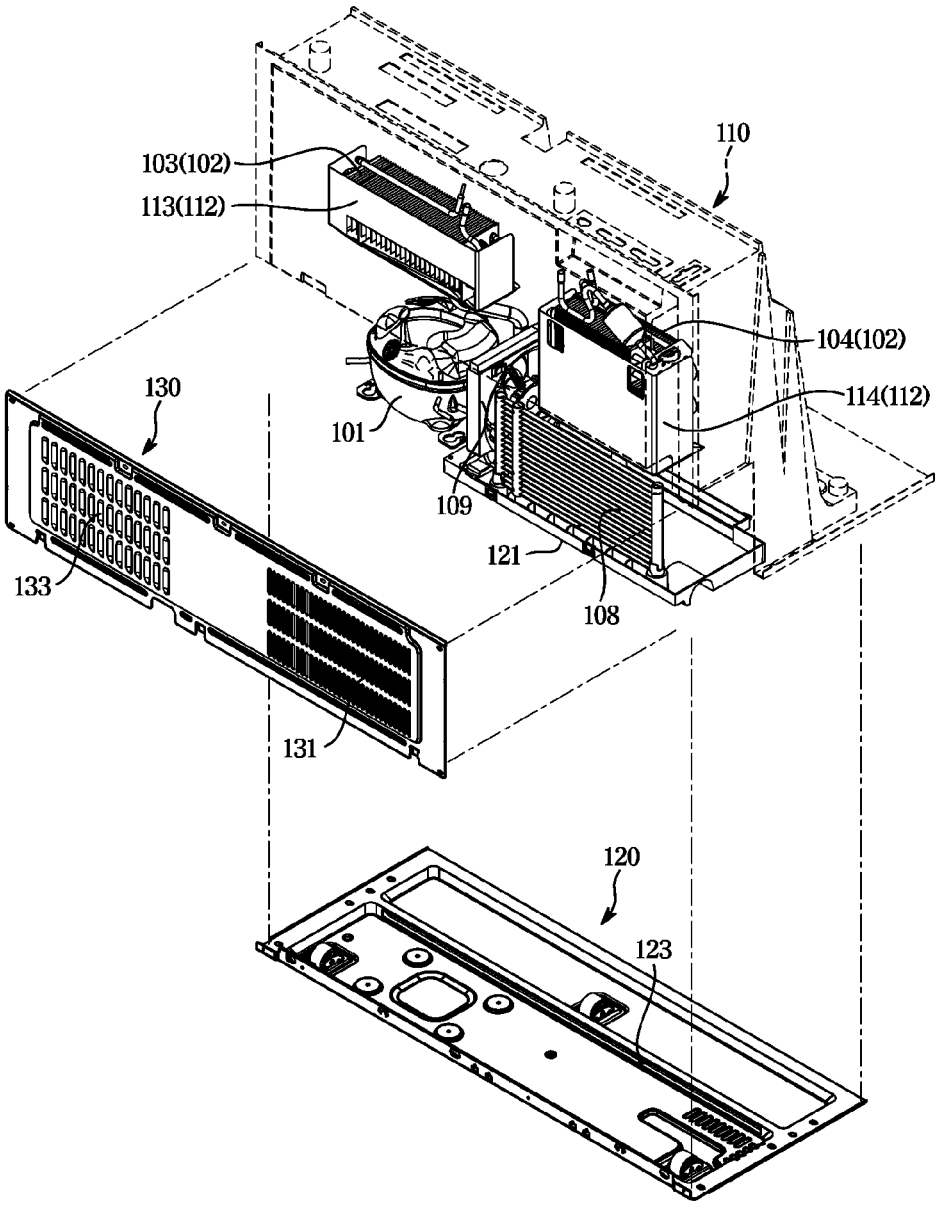
FIG. 8 is a view illustrating a part of a cooling module of a refrigerator according to another embodiment of the present disclosure.

FIG. 8 is a view illustrating a part of a cooling module of a refrigerator according to another embodiment of the present disclosure.

As illustrated in FIG. 8, the condenser 108 may be formed as a flat plate having a straight shape. When the condenser 108 is formed as a flat plate having a straight shape, the condenser 108 may be formed to correspond to a portion of the rear surface of the machine compartment S. Compared with the cooling module illustrated in FIG. 5, because the remaining configurations are the same except for the shape of the condenser 108, a description thereof will be omitted. However, when the condenser 108 is formed as a flat plate having a straight shape, as for the suction flow paths through which outside air are sucked, only one of the first suction flow path 131 formed in the module cover 130 may be provided.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body having a storage compartment formed therein; and a cooling module forming a machine compartment in which a compressor is disposed and detachably mounted to the main body, wherein the cooling module comprises:

a module body forming the machine compartment;

a condenser of an L shape disposed on one side of the compressor and comprising a first part corresponding to a portion of a rear surface of the machine compartment and a second part corresponding to one side of the machine compartment;

a base plate disposed below the module body and on which the condenser is vertically mounted;

a module cover provided to cover the rear of the machine compartment;

a suction flow path comprising a first suction flow path formed on the module cover to correspond to the first part, and a second suction flow path formed on the main body to correspond to the second part; and an evaporator to generate cold air to be supplied to the storage compartment and comprising a first evaporator and a second evaporator disposed at a side of the first evaporator;

wherein, the module body comprises a first evaporator mounting part in which the first evaporator is mounted, and a second evaporator mounting part in which the second evaporator is mounted, and the second evaporator has a larger capacity than the first evaporator, and the second evaporator mounting part is provided to be longer downward than the first evaporator mounting part.

2. The refrigerator according to claim 1, further comprising a first discharge flow path formed on the module cover to allow air inside the machine compartment to be discharged to the outside, and a second discharge flow path formed on the base plate to allow air inside the machine compartment to be discharged to the outside.

3. The refrigerator according to claim 1, wherein the storage compartment comprises a first storage compartment provided as a refrigerating compartment, a second storage compartment provided below the first storage compartment as a freezing compartment, and a third storage compartment provided on one side of the second storage compartment as a temperature variable compartment.

4. The refrigerator according to claim 3, wherein the first evaporator is configured to generate cold air to be supplied to the first storage compartment and the third storage compartment, and the second evaporator is configured to generate cold air to be supplied to the second storage compartment and the third storage compartment.

5. The refrigerator according to claim 4, wherein the condenser is disposed at a lower portion of the second evaporator mounting part, and the lower portion of the second evaporator mounting part having a length longer than that of the first evaporator mounting part is provided to be located in the front of the condenser.

6. The refrigerator according to claim 5, wherein the cooling module further comprises a duct module configured to move cold air generated in the evaporator to the storage compartment.

7. The refrigerator according to claim 6, wherein the duct module comprises a first duct module disposed in the first evaporator mounting part to move cold air generated in the first evaporator to the first storage compartment and the third storage compartment, and a second duct module disposed in the second evaporator mounting part to move cold air generated in the second evaporator to the second storage compartment and the third storage compartment.

8. The refrigerator according to claim 7, wherein the first duct module is connected to the first storage compartment by a first cold air duct and to the third storage compartment by a third cold air duct.

9. The refrigerator according to claim 8, wherein the second duct module is connected to the second storage compartment by a second cold air duct.

10. The refrigerator according to claim 9, wherein the first duct module comprises a first-a fan outlet in communication with the first cold air duct and a first-b fan outlet in communication with the third cold air duct.

11. The refrigerator according to claim 10, wherein the second duct module comprises a second fan outlet in communication with the second cold air duct.

12. The refrigerator according to claim 11, wherein the module body comprises a separation wall to separate the first evaporator mounting part and the second evaporator mounting part, and a connection duct provided on the separation wall to communicate the first evaporator mounting part and the second evaporator mounting part.

* * * * *